US007976007B2

(12) United States Patent
Collings

(10) Patent No.: US 7,976,007 B2
(45) Date of Patent: Jul. 12, 2011

(54) MULTIPLE SHEET FEED PERFORMANCE ENHANCING SYSTEM

(75) Inventor: David G. Collings, Shelton, CT (US)

(73) Assignee: Pitney Bowes Inc., Stamford, CT (US)

( * ) Notice: Subject to any disclaimer, the term of this patent is extended or adjusted under 35 U.S.C. 154(b) by 1518 days.

(21) Appl. No.: 11/132,623

(22) Filed: May 19, 2005

(65) Prior Publication Data

US 2006/0261542 A1 Nov. 23, 2006

(51) Int. Cl.
*B65H 85/00* (2006.01)

(52) U.S. Cl. ..... 271/3.17; 271/4.03; 271/10.03

(58) Field of Classification Search ..... 414/790.7; 271/3.15, 3.17, 4.02, 4.03, 10.02, 10.03, 271/258.01, 259, 265.01, 265.02, 262, 263, 271/265.04, 220, 224, 213, 216
See application file for complete search history.

(56) References Cited

U.S. PATENT DOCUMENTS

| | | | | |
|---|---|---|---|---|
| 4,030,722 | A * | 6/1977 | Irvine et al. | 271/10.13 |
| 4,083,555 | A * | 4/1978 | Irvine et al. | 271/10.13 |
| 4,753,433 | A | 6/1988 | Rodi et al. | |
| 5,996,988 | A | 12/1999 | Helmstadter et al. | |

FOREIGN PATENT DOCUMENTS

| | | | |
|---|---|---|---|
| EP | 0 295 584 | A | 12/1988 |
| EP | 0 393 589 | A1 | 10/1990 |
| JP | 2002173234 | A | 8/2000 |

OTHER PUBLICATIONS

Elsag brochure—Shingle Technology (undated)—9 pages.

* cited by examiner

*Primary Examiner* — Michael C McCullough

(74) *Attorney, Agent, or Firm* — Brian A. Collins; Charles R. Malandra, Jr.

(57) ABSTRACT

A multiple media feed system includes an adjustable media singulator feeder that is adjustable to feed from a stack of media items a selectable number of media items to form a group of overlapped media items. A thickness sensor is positioned to measure the thickness of media items fed from the stack of media items. A controllable media feeder is positioned to engage and feed media items fed from said stack of media items by the adjustable media singulator feeder. The controllable media feeder is controlled to feed media items when the thickness sensor has determined that the thickness of the selected number of media items is at the controllable media feeder.

7 Claims, 7 Drawing Sheets

MULTIPLE SHEET FEED PERFORMANCE ENHANCING SYSTEM

FIELD OF THE INVENTION

The present invention relates to media item feeding equipment, and more particularly, to a cut sheet feeder capable of simultaneously feeding multiple sheets to provide enhanced operation.

BACKGROUND OF THE INVENTION

Many types of office equipment, such as inserters and folders, have systems which feed sheets in a single sheet feeder format. In this arrangement, a sheet is singulated and fed from a stack of sheets and transported toward the process. A gap is provided and a subsequent sheet is singulated and passed on to the transport. The time to feed a single sheet is replicated with each sheet being fed. The time to feed three sheets is approximately three times the time to feed a single sheet. Accordingly, the throughput of the system goes down as each additional sheet is made part of any collations of sheets to be processed.

In systems of the above type, efforts are made to ensure that the feeder does not double-feed or multiple-feed various sheets of paper. This will cause the system to be stopped. This is often termed stream feeding and involves multiple feeding of sheets as a single pack.

It has been recognized that systems can be provided where multiple sheets are processed at a single time. For example, U.S. patent application Ser. No. 10/968,522 filed Oct. 19, 2004, in the names of Douglas B. Quine and Christopher A. Baker and entitled System And Method For Grouping Mail Pieces In A Sorter, assigned to Pitney Bowes Inc., disclose a method and system for processing of media items which includes a separator system feeding a series of media items onto a transport system. The separator system is controlled to feed onto the transport system groups of sequential media items having similar destination information and to separate and feed onto the transport system sequential media items having dissimilar destination information spaced apart on said transport system from the group of media items having similar destination information. The separator system may be controlled to limit the thickness of each group of media items not to exceed a predetermined thickness. The separator system may also be controlled to separate and feed onto the transport system any subsequent media items which would cause said group of media items to exceed the predetermined thickness.

SUMMARY OF THE INVENTION

It is an object of the present invention to provide a media feeding arrangement that enhances the processing efficiency for media items by feeding a selectable number of media items as a group of media items.

It is a further object of the present invention to provide a system which is adjustable to facilitate the use of various type media items to be processed such as media items of various length and of various materials having different coefficients of friction.

A multiple media feed system embodying the present invention includes an adjustable media singulator feeder that is adjustable to feed from a stack of media items a selectable number of media items to form a group of overlapped media items. A thickness sensor is positioned to measure the thickness of media items fed from the stack of media items. A controllable media feeder is positioned to engage and feed media items fed from said stack of media items by the adjustable media singulator feeder. The controllable media feeder is controlled to feed media items when the thickness sensor has determined that the thickness of the selected number of media items is at the controllable media feeder.

In a multiple media feed system, a method of feeding a selected number of media items from a stack of media items, a method embodying the present invention includes providing an adjustable singulating mechanism positioned to feed media items from the stack of media items. The drag force on the top media item in the stack of media items is measured. The adjustments of a singulator mechanism is set based on the measured drag force. The setting is such that the singulator mechanism separates from the stack of media items overlapped media items to form a group of media items of the selected number of media items.

BRIEF DESCRIPTION OF THE DRAWINGS

Reference is now made to the various figures wherein similar reference numerals designate similar items in the various views and in which.

DETAILED DESCRIPTION OF THE PREFERRED EMBODIMENT

Figure 1:
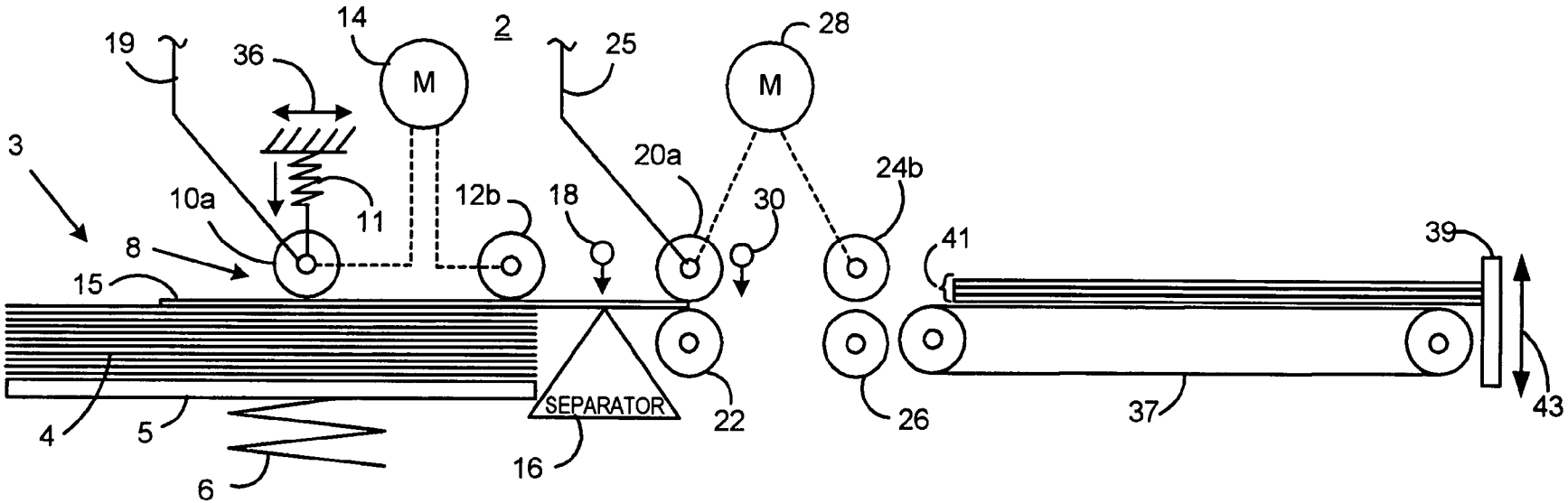
FIG. 1 is a diagrammatic view of a multiple sheet feed performance enhancing system embodying the present invention, with a first media item staged at the nip of an arming drive roller and associated idler roller.

Reference is now made to the various figures. FIGS. 1-4 are the multiple sheet feed system 2 with sheets in various stages of being shingle fed from a stack of sheets 4. As shown in FIGS. 1-4, a cut sheet feeder 3 includes a stack of sheets 4 in a feed tray 5. The stack of sheets 4 are urged by a spring-loaded mechanism 6 toward a singulator sheet drive system 8. The singulator sheet drive system 8 is provided with an adjustable mechanism to feed a selected number of sheets from the stack of sheets 4.

The multiple sheet feed system 2 employs both overrunning dynamic clutch type rollers, hereinafter identified to by the letter "a" after the drawing reference number and overrunning static clutch type rollers, hereinafter identified to by the letter "b" after the drawing reference number. Various types of drive arrangements including dynamic and static drive arrangements may be employed in the system 2, as for example the roller arrangements shown in FIGS. 1*a* and 1*b*.

Figure 1B:
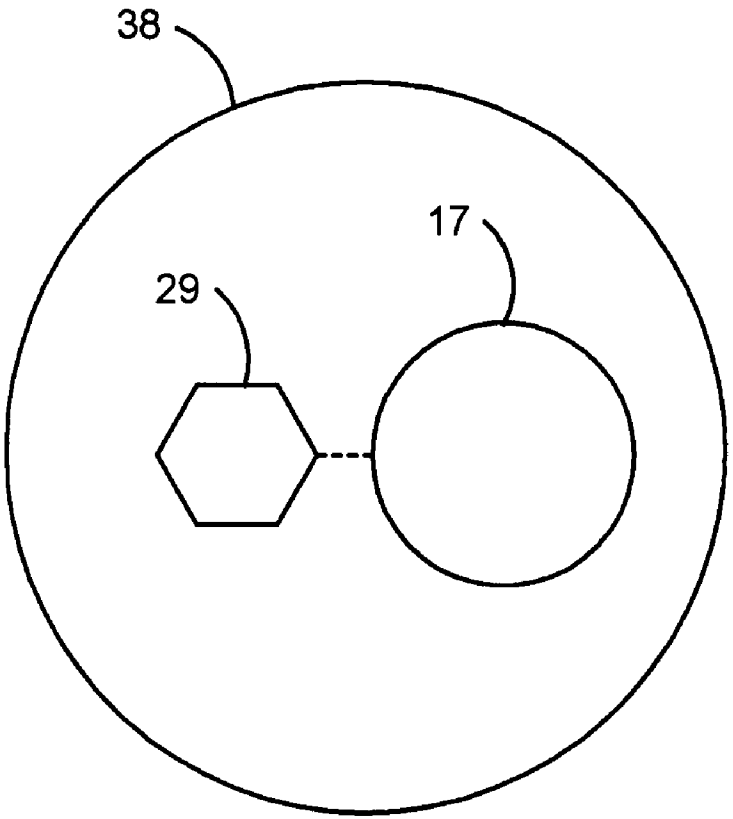
FIG. 1*b* is a diagrammatic view of an overrunning static clutch employed in the multiple sheet feeding performance enhancing system shown in FIG. 1.
Figure 1A:
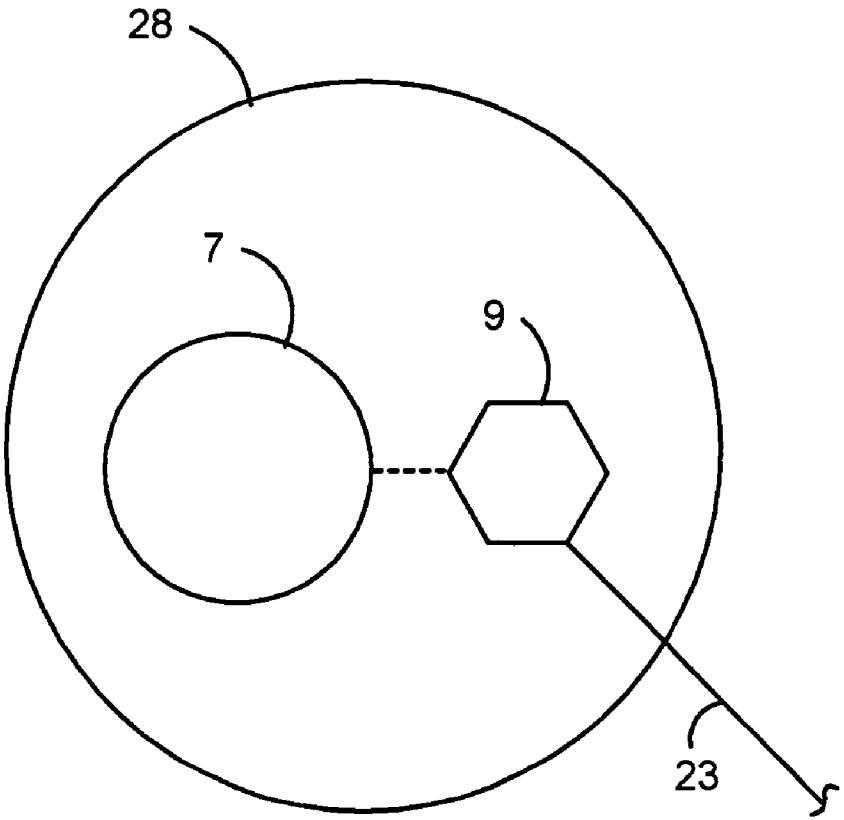
FIG. 1*a* is a diagrammatic view of an overrunning dynamic clutch employed in the multiple sheet feeding performance enhancing system shown in FIG. 1.

As shown in FIG. 1*a*, urge roller 28 is comprised of a roller 7 and an overrunning dynamic clutch 9 permitting the roller to be either on or off when the motor is active. The overrunning portion of the clutch permits the roller to turn when the material under it is under drive from an upstream roller lessening the drive force on the piece and reducing the possibility of tearing action on the piece as a result. A control signal on lead 23 determines whether the clutch is engaged or disengaged.

As shown in FIG. 1*b*, drive roller 38 is comprised on a roller 17 and an overrunning static clutch 29. The overrunning portion of the clutch permits the roller to turn when the material under it is under drive from an upstream roller lessening the drive force required to move the piece and reducing the possibility of tearing action on the piece as a result.

Referring again to FIGS. 1-4, the sheet drive system 8 includes a pre-feed roller assembly 10*a* and a feed roller assembly 12*b*. The pre-feed roller assembly 10*a* and feed roller assembly 12*b* are both controlled by a feed motor 14 and an associated control signal on lead 19. A sheet of paper, such as cut sheet 15, is fed by the pre-feed roller assembly 10*a* and feed roller assembly 12*b* to a separator station 16. The separator station may be of any conventional number of separators, including a separator drive roller operating in conjunction with a separator stone or any other suitable mechanism for separating cut sheets.

A thickness sensor 18 senses the thickness of sheet 15 at the separator station 16. The sheet 15 is driven toward an arming nip consisting of an arming drive roller assembly 20*a* and an idler roller 22. This clutch mechanism of drive roller assembly 20*a* functions to control the operation of the drive roller assembly 20*a* to control the number of sheets being fed to the take-away nip of drive roller assembly 24*b* and idler roller 26. Drive roller assembly 24*b* operates to take away and move the various differing number of overlapping sheets from the sheet drive system 8. The arming drive roller assembly 20*a* and take-away drive roller assembly 24*b* operate under control of the take-away drive motor 28 and associated a control signal on lead 25. The arming drive roller assembly 20*a* is driven to rotate by take away motor 28. The overrunning clutch of arming drive roller assembly 20*a* is controlled by the control signal on lead 25 to vary the drive torque applied by arming roller assembly 20*a* to drive the sheet(s).

On piece initiation, the first sheet 15 is staged at the material sensor by turning on motors 14 and 28 and control signals on leads 19 and 25 until the first sheet is seen by material sensor 30. At this point the feeder motor 14 and control signals 19 and 25 are turned off. The accumulator transport 37 is clear for the next piece to be assembled by gate 39 being activated to enable the previous accumulation to be moved out of transport 37, and motor 14 as well as control signals on leads 19 and 25 turn on to begin assembly of the next piece with gate 39 again in the blocking position. The control signal on lead 19 is turned off once the end of the last sheet has passed by the roller (controlled by signals from thickness sensor and materials sensor 30). When the last piece has reached the arming roller assembly 20*a*, motor 14 can be turned off.

Once the last piece has reached takeaway roller assembly 24*b*, the control signal on lead 25 can be turned off. When the end of the last sheet has passed take away roller assembly 24*b*, motor 28 can be turned off. When the end of the last piece in the collation has passed the thickness sensor and sufficient interpiece gap has been generated, then motor 14 and the control signal on lead 19 can be turned back on to arm the first sheet of the next collation. This completes the cycle of piece assembly.

Figure 3:
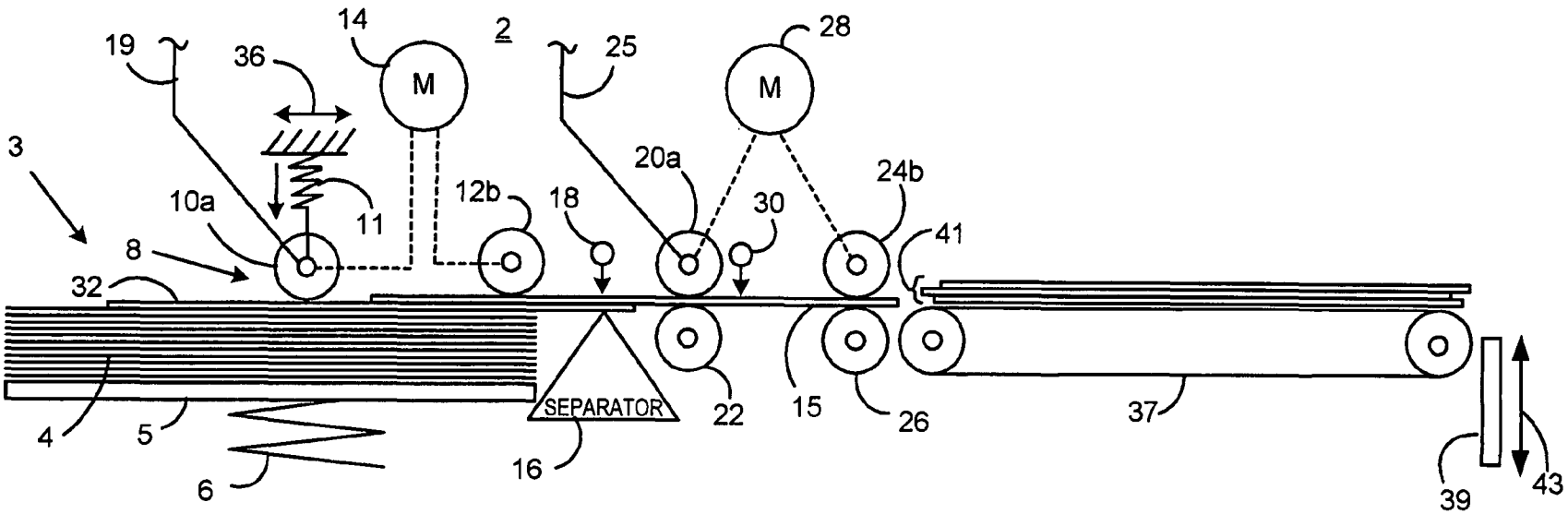
FIG. 3 is a diagrammatic view of the multiple sheet feed system shown in FIG. 1 with a second media item being fed with the first media item.
Figure 4:
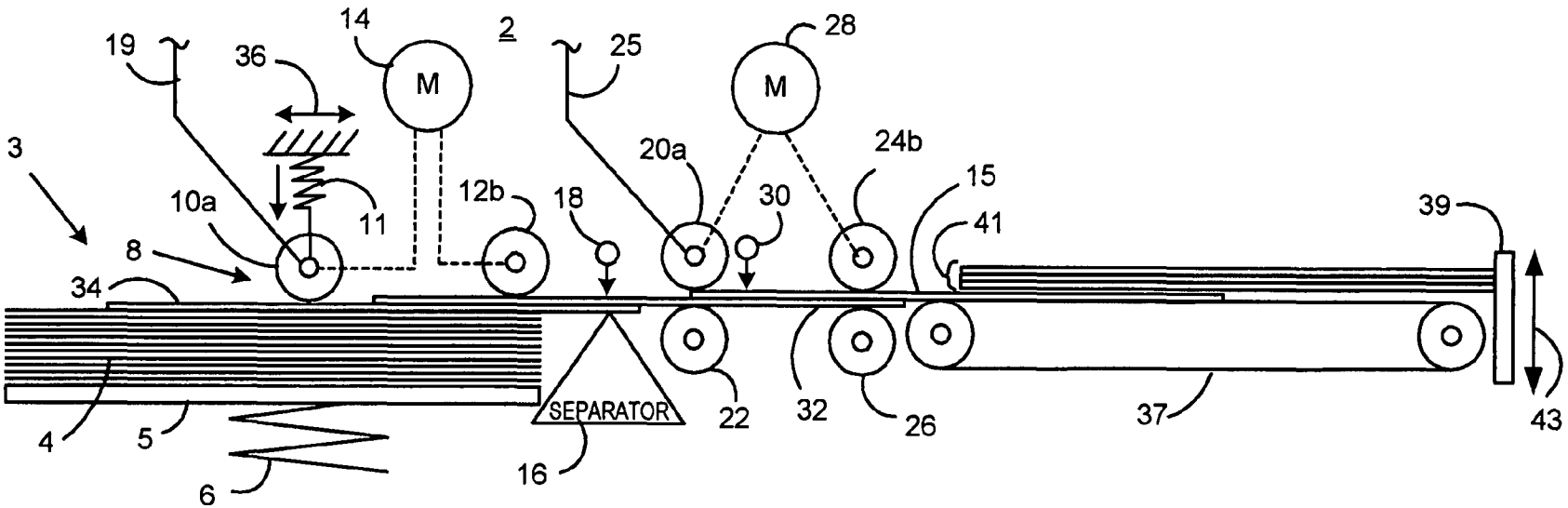
FIG. 4 is a diagrammatic view of the multiple sheet feed system shown in FIG. 1 with a third media item being fed with the second media item and further including a downstream accumulator transport and accumulator gate.

The material sensor 30 is provided to sense the presence of material between the arming nip roller assembly 20*a* and idler roller 22 and the take-away nip formed by take away roller assembly 24*b* and idler roller 26. An accumulator transport 37 is provided for transporting accumulated sheets 41. An accumulator gate 39 is also provided to control transport of the accumulation 41. The accumulator gate 39, shown in the blocking position in FIGS. 1 and 4, is moveable in and out of the blocking position as denoted by line 43 with two arrowheads. The accumulator gate is shown in the non-blocking position in FIGS. 2 and 3.

Figure 2:
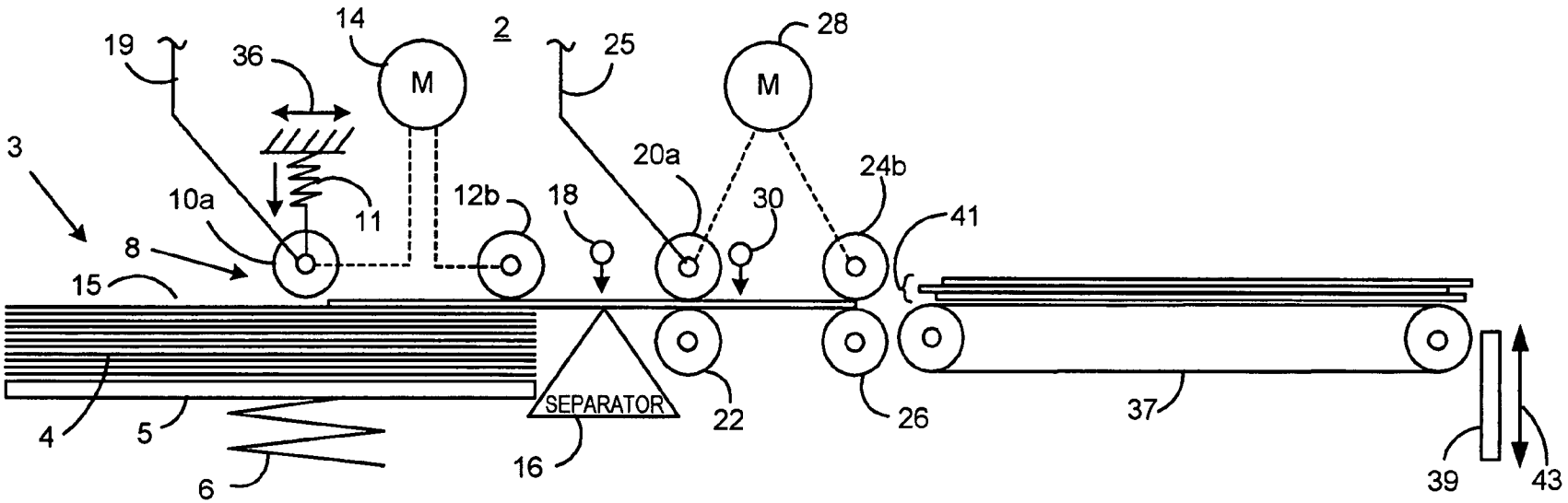
FIG. 2 is a diagrammatic view of the multiple sheet feed system shown in FIG. 1 with a first media item being fed from a stack of media items.

As is shown in FIG. 2, sheet 15 is shown as being fed with the pre-feed roller assembly 10*a* being now clear of the trailing edge of the sheet 15. The pre-feed roller spring 11 drives the pre-feed roller assembly 10*a* down in the direction of the stack of sheets 4, as shown in FIGS. 3 and 4. The pre-feed roller 10*a* engages a second sheet 32 (FIG. 3) in the stack of sheets 4 to drive sheet 32 in the direction of the separator station 16. As can be seen in FIG. 3, the thickness sensor 18 is sensing the thickness of two sheets, sheet 15 and sheet 32. This is used to count the total number of sheet thickness that have been processed in order to control the operation of motors 14 and 28, as well as the control signals on leads 19 and 25 to provide sufficient torque to drive one or more sheets through the system to the accumulator transport 37, as shown in FIG. 4.

The pre-feed roller assembly 10*a*, as is shown in FIG. 4, is further urged to engage yet a third sheet 34 in the stack of sheets 4. This begins to drive sheet 34 toward the separator station 16. When the thickness sensor 18 senses the desired number of sheets at the separator station 16, the drive of both pre-feed roller assembly 10*a* and feed roller assembly 12*b* are stopped by feed motor 14. Accordingly, additional sheets are not fed from the stacks of sheets 4 toward the separator station 16 until the entire desired shingled group of sheets are moved away downstream for further processing toward the accumulator transport 37 and accumulator gate 39, where a group of sheets 41 are aligned to form a single collation for further processing. The accumulator gate 39, shown in the blocking position in FIG. 4, is moveable in and out of the blocking position as denoted by line 43 with two arrowheads. The further processing may include, for example, folding of the collation, insertion of the collation, binding of the collation and the like.

The pre-feed roller assembly 10*a* and spring 11 are adjustable and are moveable. The pre-feed roller assembly 10*a* and spring 11 may be positioned to accommodate different length sheets and can be moved in either direction, as shown by line 36 with two arrowheads. The ability to selectively position the pre-feed roller 10*a* helps maximize the performance of the system 2 by accommodating stacks of sheets of differing lengths. Absent adjustment along line 36, the pre-feed roller 10*a* would need to be positioned to accommodate the shortest length material that could be fed from the stack of sheets 4. By making the pre-feed roller assembly 10*a* position adjustable, the performance of the system is maximized, depending upon the different lengths of material being fed. The force exerted by spring 11 may also be made adjustable. This accommodates different types of materials being fed, which may have different coefficients of friction between sheets within the stack 4. These adjustments can greatly enhance the operation of the system 2, where different lengths and types of media are to be processed by system 2. Thus, for shorter type media in the stack, the pre-feed roller assembly 10*a* would be moved in the direction of the separator system 16. For longer type media in the stack, the pre-feed roller assembly 10*a* would be moved in the direction away from the separator system 16. The positioning of the pre-feed roller assembly 10*a* and spring 11 force is a matter of design choice and can be accomplished through trial and error until the optimum position is obtained.

The prefeed roller assembly 10*a* and the feed roller assembly 12*b* are driven together by motor 14, but the control signal on lead 19 permits turning off prefeed roller assembly 10*a* and continuing to drive with feed roller assembly 12*b*. The arming nip roller assembly 20*a* and the takeaway roller assembly 24*b* can be either driven together or arming nip roller can be turned off using the control signal on lead 25 while continuing to drive with takeaway roller assembly 24*b*, as is shown in FIGS. 1-4, or separately, depending on down stream requirements. The arm feeder commands can include commands to turn on the feed motor 14 until the leading edge of the sheet is at the thickness sensor 18. A control stop command is provided when the sheet just reaches the arming nip formed by drive roller assembly 20*a* and idler roller 22. The command may then be provided to wait for a feed command.

The feeder commands can include commands to turn on the takeaway motor 28 and to turn on the feed motor 2. A command is provided to monitor thickness sensor 18 for leading edge and trailing edge thickness changes until the last leading edge has been seen. A command may also be provided to delay feeding until the last leading edge is in the arming nip formed by drive roller 20*a* and idler roller 22. A command is provided to turn off the feed motor 14 until thickness sensor 18 is clear of material. A command may also be provided to wait for a delay period and to arm the feeder.

By using two or three motors and a single thickness sensor 18, multiple sheets can be fed in an overlapped stream reducing the time needed to feed the sheets at any given drive speed. The larger the overlap the greater the gain in throughput. Also, the larger the number of sheets, the greater the gain in throughput. The accumulator transport 37 and gate 39 arrangement can realign the sheets, if desired, into a single aligned collation such as collation 41 shown in FIG. 4. The thickness sensor is used to detect lead and trail edges even when fully blocked by utilizing, for example, a burn through sensor such as ones used in the in the Pitney Bowes Inc. DI350 Officeright Inserting System. It may be desirable to limit the number of sheets that are under the thickness sensor 18 to two or less to improve the reliability of control. This may effectively limit allowable overlap to, for example, approximately 40%.

Figure 5:
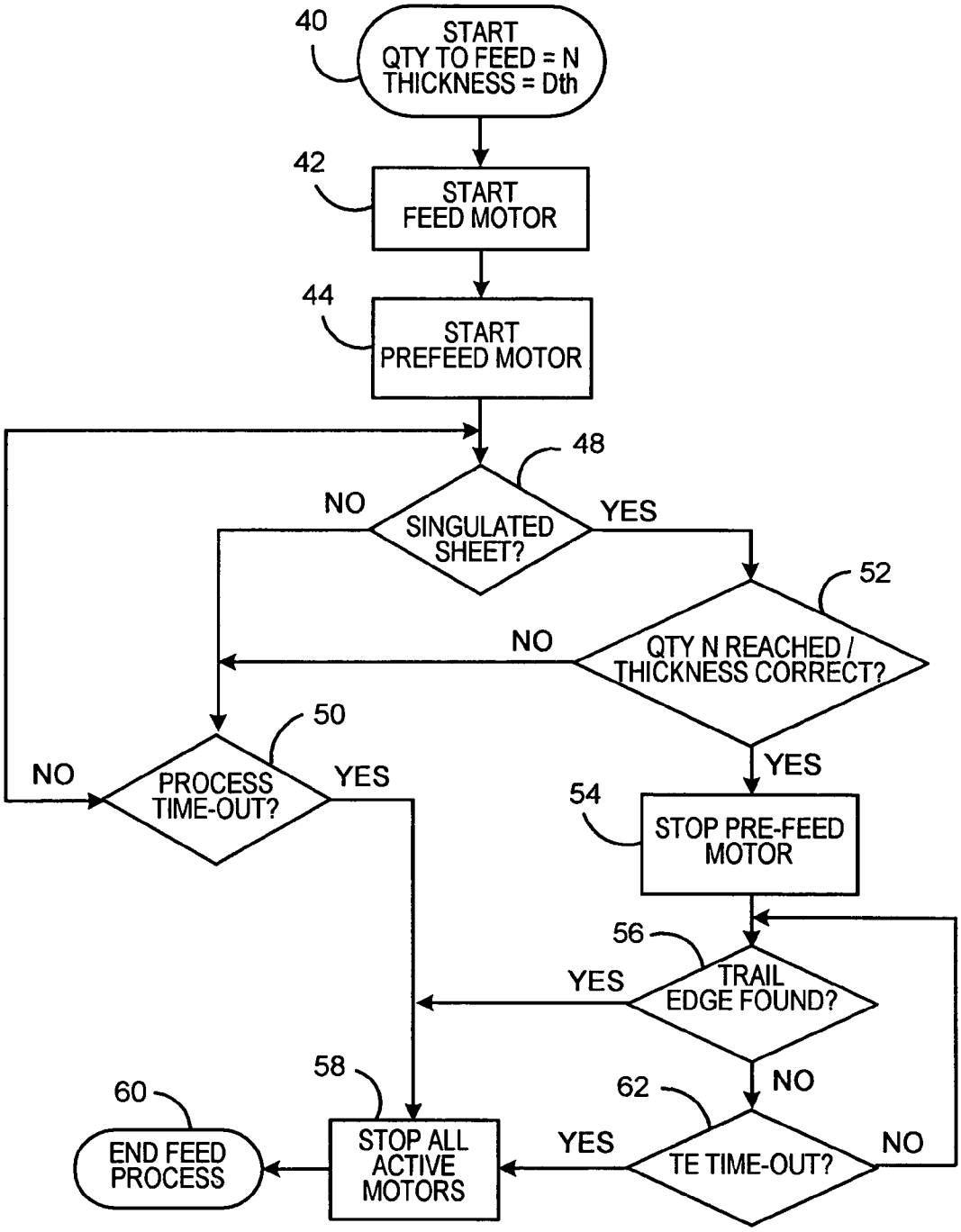
FIG. 5 is a flowchart of the operation of the multiple sheet feed system shown in FIGS. 1-4; and, FIG. 6 is a flowchart of the process for setting the multiple sheet feed system parameters for operating the system shown in FIGS. 1-5 to run a specific media item processing job as shown in FIG. 5.

Reference is now made to FIG. 5, showing the operation of the multiple sheet feed system 2. The process starts at 40. The motor 14 to drive feed roller assembly 12*b* is started at 42 and the pre-feed roller assembly 10*a* at 44. A determination is made at decision block 48 whether a sheet has been singulated. If a sheet has not been singulated, the process goes to decision block 50, where a determination is made if the process is timed out. If the process is not timed out, the system loops back to decision block 48. If the process has timed out at decision block 50, all active motors are stopped at block 58 and the process ends at 60.

Where a sheet has been singulated, the process continues to decision block 52, where a determination is made whether the correct quantity of sheets have been reached by the thickness sensor 18. Where the correct thickness has been reached, the process continues and the pre-feed motor is stopped at 54. A determination is then made at decision block 56 whether the trailing edge of the sheet has been found. If this is the case, the process continues to block 58, where all active motors are stopped. Since all of the material has passed the materials sensor 30 and the trailing edge has been found, the process stops at block 58 with all active motors stopped and the feed process ends at 60.

When a determination is made at decision block 52 that a correct quantity of sheets has not been reached by thickness sensor 18, the process continues to decision block 50. If the process has not timed out at decision block 50, the process further loops back to decision block 48. Where the trailing edge has not been found at decision block 56, the process continues to decision block 62 to determine whether a trailing edge time-out has occurred. Where this has not occurred, the process loops back to decision block 56 and continues. However, where a trailing edge time-out has occurred at decision block 62, the process continues to block 58 and all active motors are stopped and the feed process ends at 60.

Figure 6:
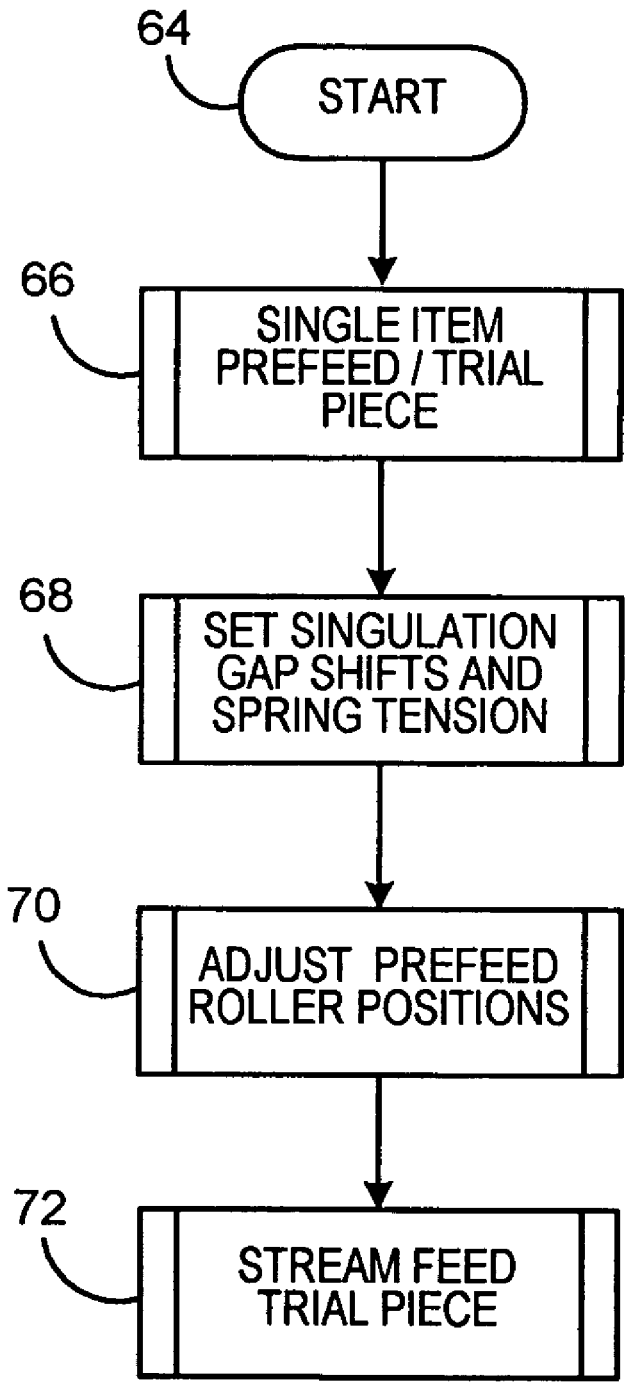

Reference is now made to FIG. 6. The set up operation of the multiple sheet feed system 2 to implement set-up of the system is shown in FIG. 6. This enables the operation of the system shown in FIG. 5. The set-up operation of the multiple sheet feed system 2 starts at block 64. At block 66, a single item pre-fed trial item has the length and thickness of the item measured and also the drag force on the top sheet. At 68, the singulation station 16 and gap shifts are set on the rollers, as well as the spring 11 tension of the pre-feed roller assembly 10*a*. These operations may be implemented manually or automatically, based on the pre-feed measurements to optimize the performance of the multiple sheet feed system 2. At 70, the position and location of the pre-feed roller 10*a* is adjusted. This also may either be implemented manually or automatically, based on the system design. Finally, at 72, a stream feed of a trial media item is implemented. The stream feed may also be automatically or manually initiated by the operator.

While the present invention has been described in connection with what is presently considered to be the most practical and preferred embodiments, it is to be understood that the invention is not limited to the disclosed embodiment, but, on the contrary, is intended to cover various modifications and equivalent arrangements included within the spirit and scope of the appended claims.

What is claimed is:

1. A multiple media item feed system comprising:

a media item tray for holding a plurality of media items;

an adjustable prefeed roller adapted to engage and feed a selectable number of media items from said media item tray to form a group of overlapped media items when a stack of media items are loaded into said media item tray, wherein the prefeed roller is selectively positioned to improve the performance of the system for a length of the stack of media items and a force exerted by the prefeed roller on the media items is adjusted for the media items' coefficients of friction;

a thickness sensor positioned to measure a thickness of media fed from said tray by said prefeed roller; and, an arming drive roller positioned downstream of said prefeed roller and to engage media items fed from said tray, said arming drive roller controllable to feed said group of media items when said thickness sensor has measured a proper thickness of media items present at said arming drive roller for said group of media items.

2. A multiple media feed system as defined in claim 1 further comprising an overrunning clutch coupled to said arming roller and wherein said overrunning clutch is controllable to drive said arming roller with a torque dependent on the thickness of said group of media items at said arming roller.

3. A multiple media feed system as defined in claim 2 further comprising a feed roller mounted to engage said media items and positioned downstream of said prefeed roller and upstream of said arming roller and a feeder motor connected to drive said prefeed roller and said feed roller to rotate.

4. A multiple media feed system as defined in claim 3 further comprising a take away roller and a take away motor connected to said overrunning clutch and to said take away roller, said take away roller mounted to engage said media items and positioned downstream of said arming roller.

5. A multiple media feed system as defined in claim 4 further comprising a materials sensor mounted between said arming roller and said take away roller to sense the presence or absence of media items.

6. A multiple media feed system as defined in claim 5 further comprising including an accumulator transport connected to said controllable take away roller and an accumulator gate connected to said accumulator transport, said accumulator gate controllable to be moved into and out of a position where said accumulator gate blocks transport of media items being transported by said accumulator transport such that when said gate is in said blocking position said group of selected media items fed from said controllable media feeder are formed into an aligned collation of media items.

7. A multiple media feed system as defined in claim 6 wherein said media items are cut sheets of paper.

* * * * *